US006276647B1

(12) United States Patent
Stopper

(10) Patent No.: US 6,276,647 B1
(45) Date of Patent: Aug. 21, 2001

(54) WRIST AND HAND SUPPORT APPARATUS FOR ELEVATING THE HAND AND WRIST

(76) Inventor: Robin D. Stopper, 3900 N. E. 18th Ave., #14, Oakland Park, FL (US) 33334

( * ) Notice: Subject to any disclaimer, the term of this patent is extended or adjusted under 35 U.S.C. 154(b) by 0 days.

(21) Appl. No.: 09/337,480

(22) Filed: Jun. 21, 1999

(51) Int. Cl.[7] ..... B43L 15/00; A45D 29/00

(52) U.S. Cl. ..... 248/118.5; 400/715; 132/73

(58) Field of Search ..... 248/118, 118.1, 248/118.5, 918; 400/715; 601/27, 32, 33, 40, 19; 132/73

(56) References Cited

U.S. PATENT DOCUMENTS

| | | | | |
|---|---|---|---|---|
| 235,581 | * | 12/1880 | Smith | 248/118.5 |
| 549,560 | * | 11/1895 | Bradley | 248/118.1 |
| 1,308,355 | * | 7/1919 | Hollins | 248/118.1 |
| 3,888,241 | * | 6/1975 | Fischer | 128/24.3 |
| 4,329,002 | * | 5/1982 | Cowen et al. | 248/118 |
| 5,050,826 | * | 9/1991 | Johnston | 400/715 |
| 5,158,255 | * | 10/1992 | Fuller | 248/118 |
| 5,386,956 | * | 2/1995 | Hatcher | 248/918 |
| 5,433,407 | * | 7/1995 | Rice | 248/918 |
| 5,445,349 | * | 8/1995 | Hart | 248/918 |
| 5,467,952 | * | 11/1995 | Martin | 248/118.1 |
| 5,478,034 | * | 12/1995 | Cunningham et al. | 248/118.5 |
| 5,572,941 | * | 11/1996 | Arnos | 248/118 |
| 5,628,483 | * | 5/1997 | Smith et al. | 248/118 |
| 5,674,423 | * | 10/1997 | Wright, Sr. | 248/118 |
| 5,884,879 | * | 3/1999 | Gruenenfelder | 248/118 |

OTHER PUBLICATIONS

Foot Massage by Face, Rocky Mountain News, Aug. 1996, all pages.*

* cited by examiner

*Primary Examiner*—Ramon O. Ramirez
*Assistant Examiner*—Jon A Szumny
(74) *Attorney, Agent, or Firm*—Oltman, Flynn & Kubler

(57) ABSTRACT

A hand elevation apparatus includes a substantially horizontal frame support surface; a frame structure for supporting a user wrist and having two spaced apart disk end portions resting on the frame support surface for rolling across the frame support surface; and a wrist support shaft extending axially between and interconnecting the disk end portions. The disk end portions preferably each have an outwardly directed circumferential surface and each circumferential surface includes a circumferential traction groove; the apparatus additionally including an O-ring removably fit into each of the traction grooves for providing traction between the disk end portions and the frame support surface. The apparatus preferably additionally includes a wrist cushion fit around the wrist support shaft.

17 Claims, 4 Drawing Sheets

WRIST AND HAND SUPPORT APPARATUS FOR ELEVATING THE HAND AND WRIST

BACKGROUND OF THE INVENTION

1. Field of the Invention

The present invention relates generally to the field of hand and wrist support devices for receipt of nail care services and for performance of manual tasks. More specifically the present invention relates to an ergonomically designed hand elevation apparatus for elevating and supporting the hand, wrist and fingers of a person while nail care or medical service is given or received, or while the person operates a computer keyboard or mouse, or does work using repetitive hand, wrist or finger motions. The apparatus includes a spool-shaped frame structure in the form of two spaced apart disk end portions interconnected by an axial wrist support shaft, and further includes a frame support surface. It is preferred that an O-ring fit into a circumferential groove around each disk end portion to provide traction between the apparatus and the frame support surface and to protect the surface from abrasion damage. A flexible, planar cushion removably wraps around the wrist support shaft and is secured in place with fastening means. The cushion can be replaced periodically and the frame cleaned for proper sanitation. An elongate version of the frame structure is provided so that keyboards and mouse pads fit between the disk end portions and underneath the wrist support shaft and cushion, for rolling access to all areas of the keyboard or mouse pad.

2. Description of the Prior Art

There have in recent years been a variety of devices for supporting the hand and wrist of a person while a manicure is performed. The known prior art wrist support devices all include a platform which rests flat against a horizontal support surface such as a table top and which remains stationary. Most of these prior devices have complex wrist, hand or finger support structures which extend upwardly from the platform. All are relatively costly and cumbersome, and the platform itself can obstruct air vents typically built into nail service tables or work stations.

Becker, et al. U.S. Pat. No. 4,915,331, issued on Apr. 10, 1990, discloses such a structure which includes a cylindrical wrist support cross-member mounted on spaced apart posts extending upwardly from a platform. A notched finger supporting rack is mounted on a bracket connected to the platform adjacent to the cross-member. This appears to be the apparatus marketed by EASELTECH™ in its brochure.

Sexton, U.S. Pat. No. 5,184,795, issued on Feb. 9, 1993, teaches a manicure stand having arched arm and hand support panels each mounted on angled posts affixed to a platform. One of the posts telescopes to any of several selectable lengths.

Jimenez, U.S. Pat. No. 5,169,103, issued on Dec. 8, 1992, reveals a handstand for nail work. Jimenez includes a ribbon of material molded into a configuration having an angled arm support plate extending upwardly from a platform. A padded elbow support region is provided on the platform.

Kitrell, U.S. Pat. No. 4,332,263, issued on Jun. 1, 1982, teaches a manicure easel. Kitrell includes a platform from which adjustable finger and wrist support channels extend on pivotable rods. A finger support channel elevation lever mechanism is provided, part of which is contained within the platform.

Vu, et al. U.S. Pat. No. 5,470,036, issued on Nov. 28, 1995, discloses a wrist/hand support for keyboards. Vu includes a platform having wrist support elements mounted on pads which are movable over part of the platform upper surface.

NAILSMART™ is marketing a hand rest which appears to comprise a disk shaped hand support platform. See NAILS™ magazine, May 1999, advertising page immediately before page 132.

It is thus an object of the present invention to provide an apparatus including a frame structure support surface and a hand and wrist supporting frame structure which moves with the hand and wrist over the support surface, for ready placement at a comfortable location relative to the user for wrist and hand support during administration of nail service, during use of a computer or typewriter keyboard or mouse, or during repetitive work.

It is another object of the present invention to provide such an apparatus in which the frame structure rolls over the support surface to the desired location, and simultaneously rolls along the lower surface of the wrist and palm of the user hand for ready positioning of the frame structure underneath the wrist and hand to angle and position the hand as desired, and which relaxes and stabilizes the user hand, wrist or fingers.

It is still another object of the present invention to provide such an apparatus which is simple in design, compact and light weight for convenient transport and storage.

It is a further object of the present invention to provide such an apparatus which does not include a platform or other structure that significantly obstructs air flow through a vent in the support surface.

It is a still further object of the present invention to provide such an apparatus in which the frame structure places the recipient wrist and hand at an elevation which is close enough to the support surface that a service provider can administer nail service, or medical service where the hand is stabilized such as in instances in which hand tremors are present, while resting his or her elbow on the support surface or resting his or her wrist on an edge of the support surface, such that the service provider can work with comfort and minimal fatigue, and at an elevation close enough to the support surface that the hand can readily access and operate a computer or typewriter keyboard or mouse.

It is yet another object of the present invention to provide such an apparatus in which the frame structure has a circumferential wrist support cushion which is removable and replaceable for proper sanitation and comfort.

It is finally an object of the present invention to provide such an apparatus which is inexpensive to manufacture, easy to operate and durable.

SUMMARY OF THE INVENTION

The present invention accomplishes the above-stated objectives, as well as others, as may be determined by a fair reading and interpretation of the entire specification.

A hand elevation apparatus is provided, including a substantially horizontal frame support surface; a frame structure for supporting a user wrist and having two spaced apart disk end portions resting on the frame support surface for rolling across the frame support surface; and a wrist support shaft extending axially between and interconnecting the disk end portions.

The disk end portions preferably each have an outwardly directed circumferential surface and each circumferential surface includes a circumferential traction groove; the apparatus additionally including an O-ring removably fit into each of the traction grooves for providing traction between the disk end portions and the frame support surface. The apparatus preferably additionally includes a wrist cushion fit around the wrist support shaft. The wrist cushion preferably includes a foam interior and a flexible outer skin. The wrist cushion is removably wrapped around the wrist support shaft and secured with a cushion fastener. The cushion fastener preferably includes a hook and loop fastener.

The apparatus optionally additionally includes a keyboard having a keyboard length and a keyboard longitudinal axis extending between keyboard lateral ends, and resting on the frame support surface. The wrist support shaft preferably is at least as long as the keyboard length and substantially parallel with the keyboard longitudinal axis, and in this instance the keyboard is positioned between the disk end portions, so that the disk end portions are free to roll on the frame support surface beside each of the keyboard lateral ends to position the wrist support shaft and a user hand over a desired portion of the keyboard.

The frame support surface optionally includes a support surface edge substantially parallel to the wrist support shaft for supporting an arm of a nail service provider.

The apparatus alternatively additionally includes a computer mouse and a computer mouse pad having a mouse pad length and two opposing mouse pad lateral ends resting on the frame support surface. In this instance the wrist support shaft preferably is at least as long as the mouse pad length, and the computer mouse pad is positioned between the disk end portions, so that the disk end portions are free to roll on the frame support surface beside each of the mouse pad lateral ends to position the wrist support shaft and a user hand over a desired portion of the computer mouse pad.

The frame structure optionally contains a hollow region to reduce frame structure weight.

A hand elevation apparatus is further provided, including a substantially horizontal frame support surface; and a frame structure for supporting a user wrist having a disk-shaped portion resting on the frame support surface for rolling across the frame support surface.

A hand elevation apparatus is still further provided, including a substantially horizontal frame support surface; and a frame structure for supporting a user wrist having a cylindrical portion resting on the frame support surface for rolling across the frame support surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
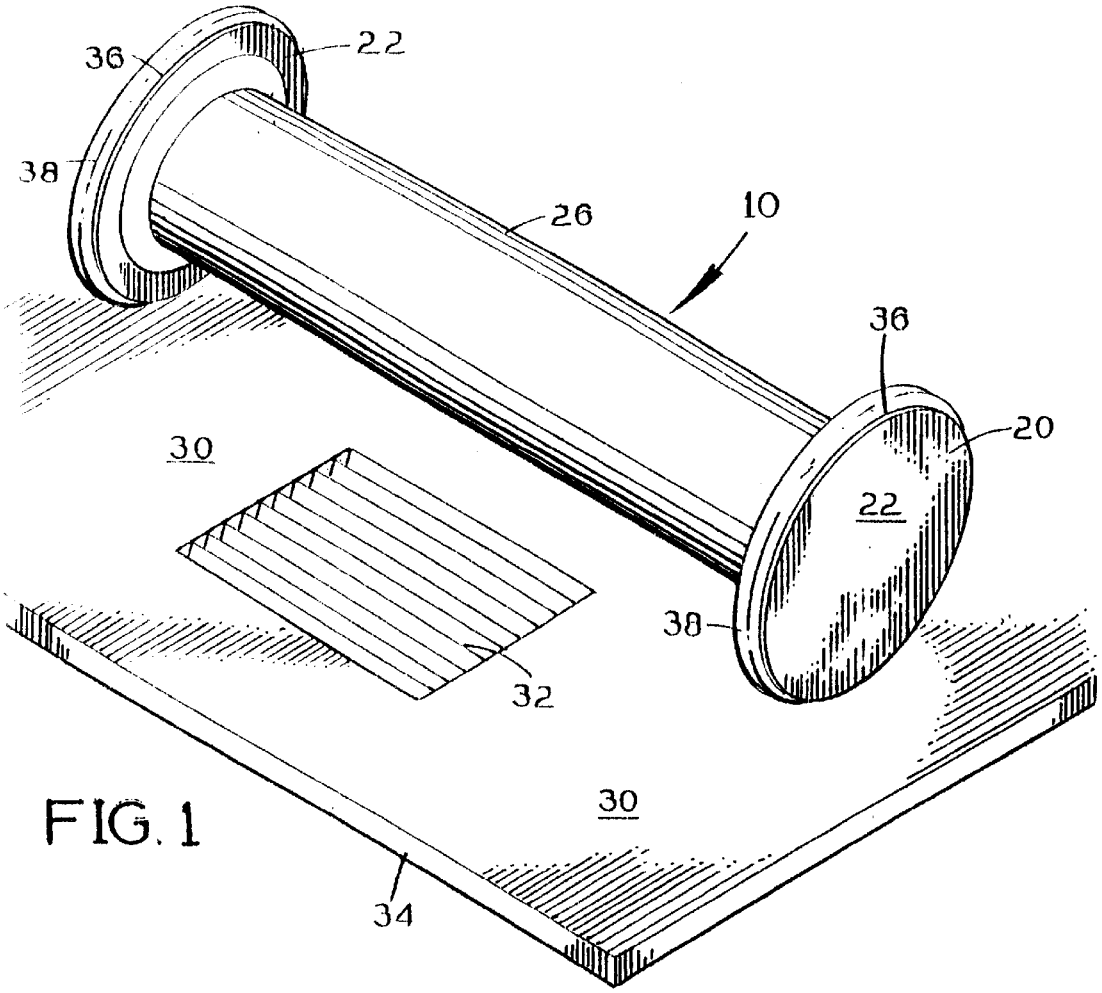
FIG. 1 is a perspective view of the apparatus of the first embodiment, where the frame support surface includes the optional air vent and arm propping support surface edge.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
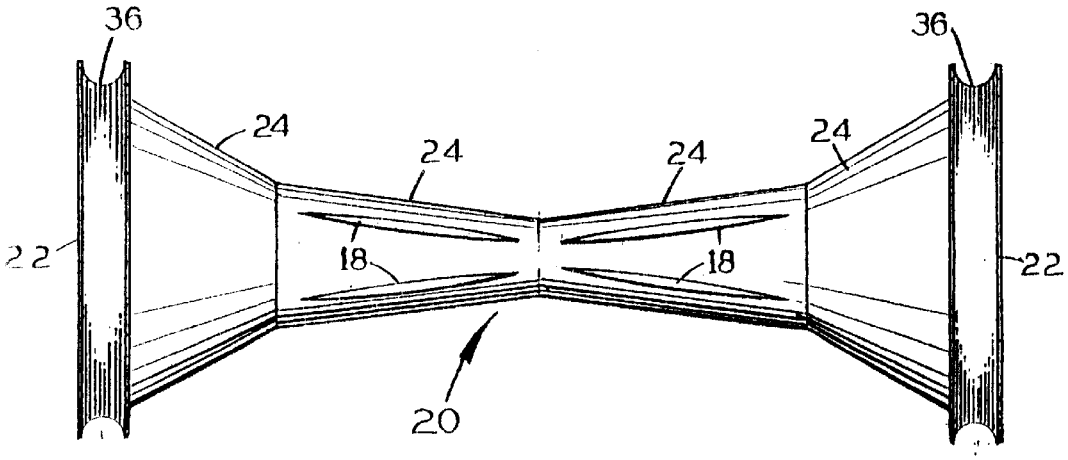
FIG. 2 is a front plan view of the frame structure of the first embodiment, showing the axial cushion retaining ribs and inwardly tapered wrist support shaft. The O-rings are omitted for a clearer view of the traction grooves.
Figure 3:
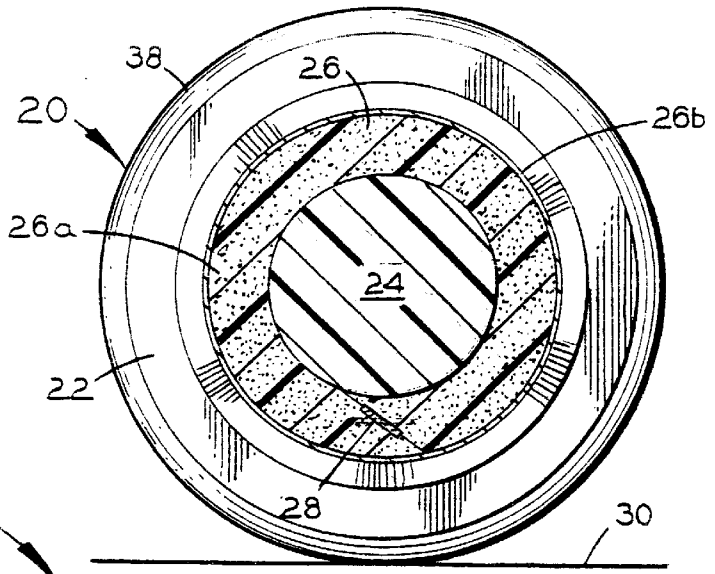
FIG. 3 is a cross-sectional side view of the frame structure of the first embodiment, showing the cushion fasteners removably holding the cushion around the wrist support shaft in its coiled configuration.
Figure 4:
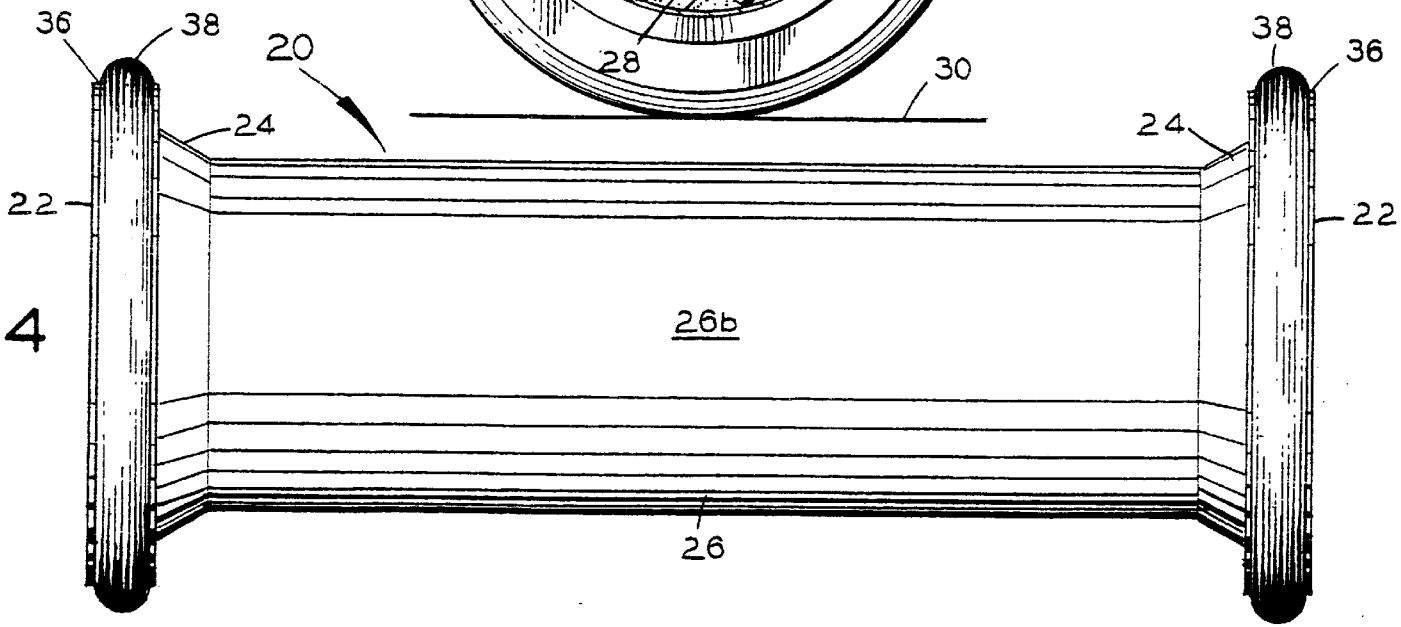
FIG. 4 is a front plan view of the wrist supporting frame structure as in FIG. 2, with the cushion and O-rings added.
Figure 5:
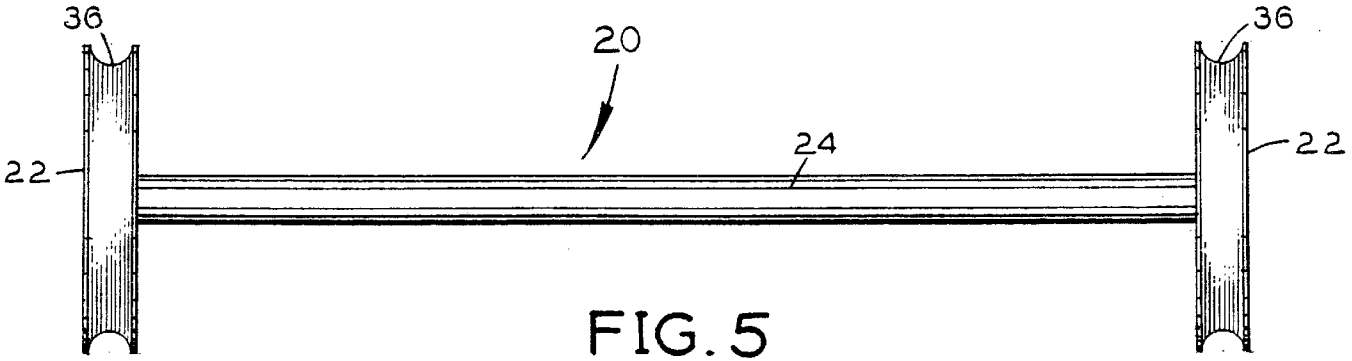
FIG. 5 a view as in FIG. 2 of the frame structure of the second embodiment.
Figure 6:
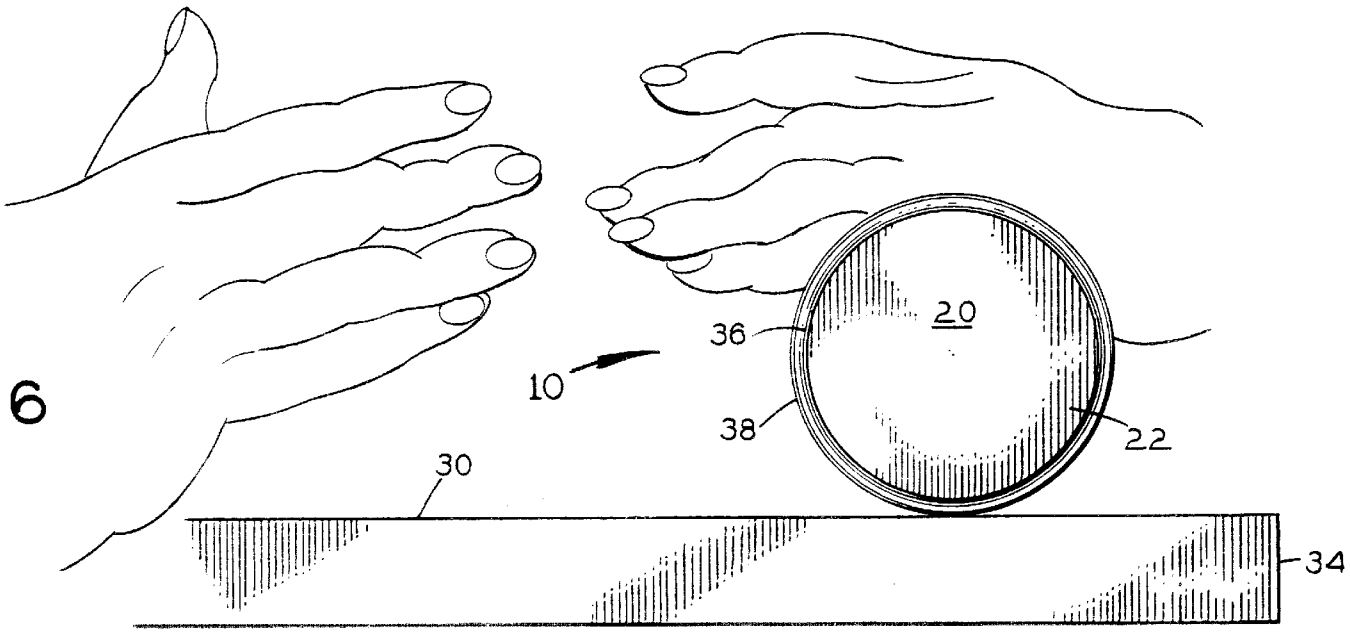
FIG. 6 is a side view of the apparatus resting on the frame support surface, with a user hand resting on the frame structure and a nail service provider resting a hand on the edge of the support surface.
Figure 7:
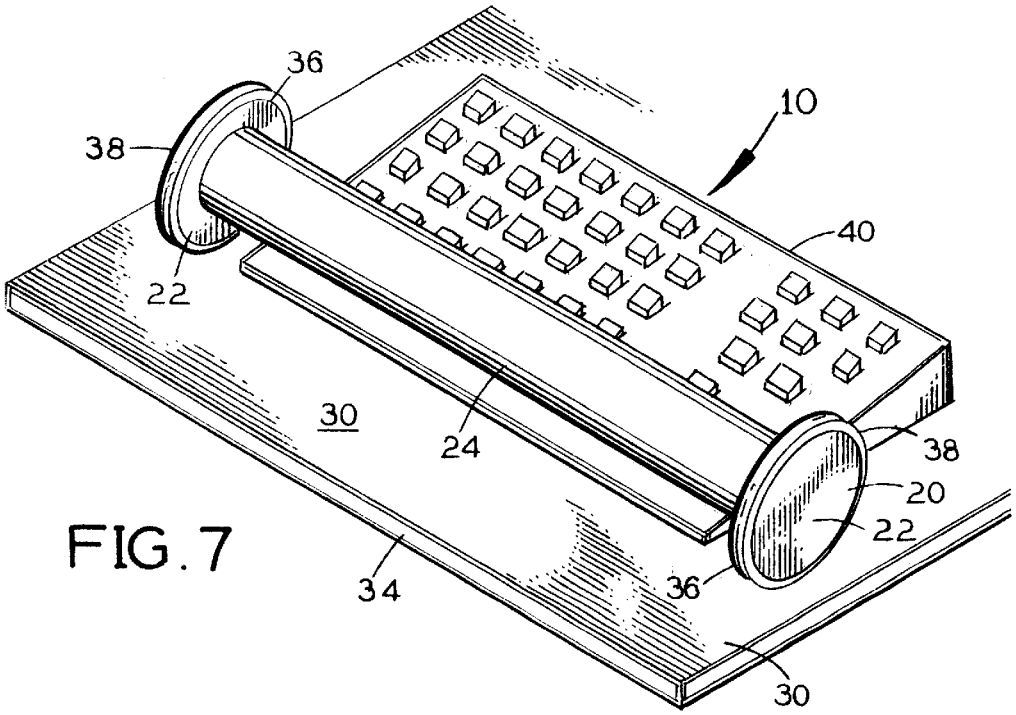
FIG. 7 is a perspective view of the second embodiment of the apparatus combined with a keyboard.
Figure 8:
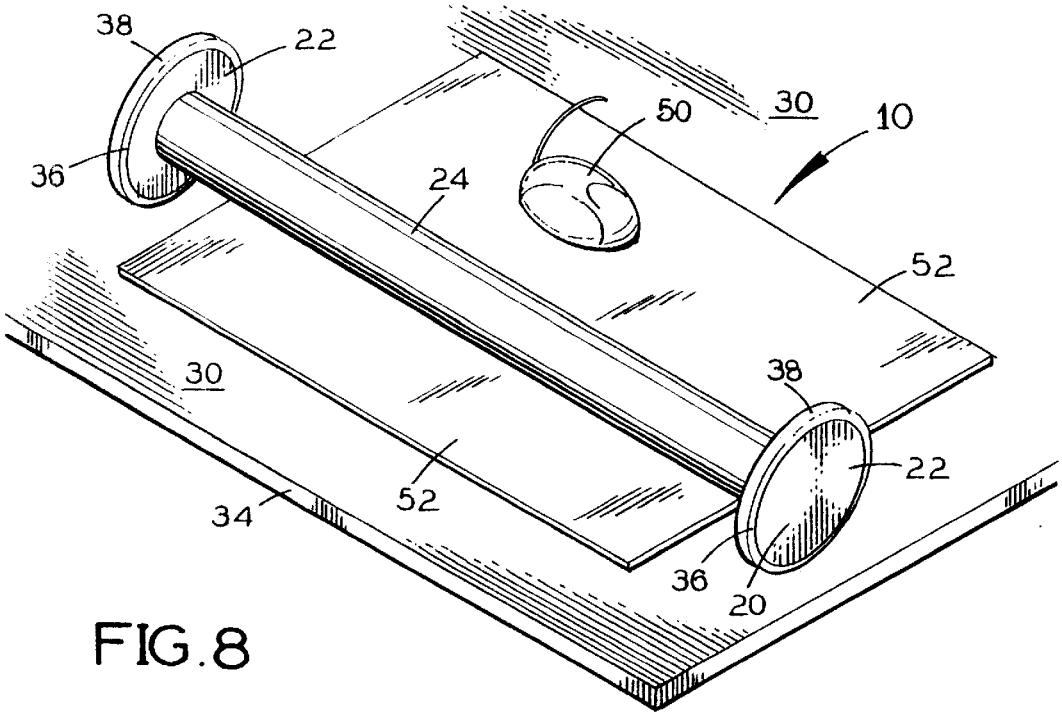
FIG. 8 is a perspective view of the second embodiment of the apparatus combined with a computer mouse and mouse pad.

Referring to FIGS. 1–8, a hand elevation apparatus 10 is disclosed for positioning the wrist and hand of a person to receive nail service or to perform repetitive assembly work. Apparatus 10 includes a substantially spool-shaped frame structure 20 in the form of two spaced apart disk end portions 22 interconnected by an axial wrist support shaft 24, and a substantially horizontal frame support surface 30 on which disk end portions 22 rest.

Frame support surface 30 may take the form of a table top and preferably has an air vent 32 connected via a duct (not shown) beneath the support surface 30 to a blower (not shown). See FIG. 1. Frame support surface 30 preferably also has a support surface edge 34 substantially parallel to wrist support shaft 24 against which a nail service provider can rest his or her wrist while administering nail service. See FIGS. 1 and 6.

Wrist support shaft 24 preferably tapers to a minimum cross-section at its mid-point to help center the user wrist and to minimize pressure at the wrist center to minimize risks of carpal tunnel syndrome. See FIG. 2. A flexible wrist cushion 26, preferably formed of a sponge material core **26*a* and having a flexible outer skin 26*b*, removably wraps around wrist support shaft 24 and is secured to itself in this coiled configuration with hook and loop or equivalent fasteners 28. See FIG. 3. Axially oriented ribs 18 are optionally provided periodically around shaft 24 to help retain cushion 26 against rotation relative to shaft 24. Each disk end portion 22 includes traction means which preferably take the form of a circumferential traction groove 36 in each disk end portion 22 circumferential and an O-ring 38 fit into each traction groove 36 and extending radially outward beyond the circumferential surface. O-rings 38 provide traction when the frame structure 20 is placed on support surface 30, and protect support surface 30 from scratching. O-rings 38** preferably are formed of rubber or an equivalent, high friction, low abrasion material.

One advantage of this design is that frame structure 20 can be rolled a short distance while the wrist is resting on frame structure 20 to pivot the hand up or down. Another advantage is that the user hand is spaced only a relatively small distance above frame support surface 30, so that a nail service provider is not physically taxed by the need to hold his or her arms uncomfortably high while providing nail service, which appears to be a universal problem of the prior art. Cushion 26 can be removed and cleaned or replaced and the frame structure 20 cleaned for proper sanitation.

The cushion outer skin 26*b* and the frame structure 20 are preferably formed of materials which are resistant to chemicals used during manicuring. Frame structure 20 is made of metal, plastic, or any other suitable material. Frame structure 20 is optionally hollow, to minimize weight and to conserve frame structure 20 material, although a solid frame structure 20 has the advantage of greater weight which can lend a measure of stability and resistance to movement once the frame structure 20 and user hand are positioned as desired.

Second Preferred Embodiment

An elongate embodiment of apparatus 10 for use in combination with computer and typewriter keyboards 40 is optionally provided, having a wrist support shaft 24 which is substantially as long as the keyboard 40. See FIGS. 5, 7 and 8. This design permits the user to place his or her hands on wrist support shaft 24 (and cushion 26) at any desired position along the keyboard 40 for wrist support and elevation while using the keyboard 40 (see FIG. 7), or while using a computer mouse 50. See FIG. 8. Wrist support shaft 24 and cushion 26 may alternatively support the user hand, user palm or user fingers.

In the instance of combination with a keyboard 40, it is preferred that wrist support shaft 24 be longer than keyboard 40 and that disk end portions 22 be of sufficient diameter that most or all of keyboard 40 fits underneath wrist support shaft 24 and any cushion 26. This construction permits disk end portions 22 to roll beside the ends of keyboard 40 for positioning of user hands above the keyboard 40 at any desired location.

In the instance of combination with a mouse 50 and mouse pad 52, it is preferred that wrist support shaft 24 be longer than mouse pad 52 so that disk end portions 22 can roll beside the lateral side edges of mouse pad 52 so that the user wrist can travel with the mouse 50 as needed during computer operation.

For these elongate versions of frame structure 20, wrist support shaft 24 is preferably of continuous cross-section along its length, and a correspondingly elongate version of flexible cushion 26 preferably encircles wrist support shaft 24. It may be desirable in some instances for the position of the user wrist and hand relative to frame structure 20 to remain fixed. Therefore ribs 18 are optionally omitted and cushion 26 made loose on shaft 24 so that wrist support shaft 24 can roll freely within cushion 26 as frame structure 20 is rolled across frame support surface 30. Except as specified herein, the second embodiment of apparatus 10 preferably is otherwise similar in design and construction to the first embodiment of apparatus 10.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A hand elevation apparatus, comprising:

a substantially horizontal frame support surface with a frame support surface edge;

a frame structure for supporting a user wrist comprising two spaced apart disk end portions resting on said frame support surface adjacent to said frame support surface edge, for rolling across said frame support surface to position said frame structure relative to said frame support surface edge and to position the user wrist relative to said frame structure simultaneously;

a wrist support shaft extending axially between and interconnecting said disk end portions having a central segment with a substantially smooth cylindrical;

and a wrist cushion slidably encircling said wrist support shaft between said disk end portions, such that said wrist cushion is slidably rotatable relative to and around said wrist support shaft.

2. The apparatus according to claim 1, wherein said disk end portions each have an outwardly directed circumferential surface and each said circumferential surface comprises a circumferential traction groove; said apparatus additionally comprising an O-ring removably fit into each said traction groove for providing traction between said disk end portions and said frame support surface.

3. An apparatus according to claim 1, wherein said frame structure contains a hollow region to reduce frame structure weight.

4. The apparatus according to claim 1, wherein said wrist cushion comprises a foam interior and a flexible outer skin.

5. The apparatus according to claim 1, wherein said wrist cushion is removably wrapped around said wrist support shaft and secured with cushion fastener means.

6. The apparatus according to claim 5, wherein said cushion fastener means comprises a hook and loop fastener.

7. The apparatus according to claim 1, additionally comprising a keyboard having a keyboard length and a keyboard longitudinal axis extending between keyboard lateral ends, and resting on said frame support surface.

8. The apparatus according to claim 7, wherein said wrist support shaft is at least as long as said keyboard length and substantially parallel with said keyboard longitudinal axis, and said keyboard is positioned between said disk end portions, such that said disk end portions are free to roll on said frame support surface beside each said keyboard lateral end to position said wrist support shaft and a user hand over a desired portion of said keyboard.

9. The apparatus according to claim 1, wherein said frame support surface comprises a support surface edge substantially parallel to said wrist support shaft for supporting an arm of a nail service provider.

10. The apparatus according to claim 1, additionally comprising a computer mouse and a computer mouse pad having a mouse pad length and two opposing mouse pad lateral ends resting on said frame support surface.

11. The apparatus according to claim 10, wherein said wrist support shaft is at least as long as said mouse pad length, and said computer mouse pad is positioned between said disk end portions, such that said disk end portions are free to roll on said frame support surface beside each said mouse pad lateral end to position said wrist support shaft and a user hand over a desired portion of said computer mouse pad.

12. A hand elevation apparatus, comprising:

a substantially horizontal frame support surface having a fume drawing vent and a fume passing passageway extending into said frame support surface and fume drawing blower means;

a frame structure for supporting a user wrist comprising two spaced apart disk end portions resting on said frame support surface for rolling across said frame support surface;

and a wrist support shaft extending axially between and interconnecting said disk end portions and spaced above said fume drawing vent, said wrist support shaft having a central segment with a substantially smooth cylindrical surface.

13. The apparatus according to claim 12, additionally comprising a wrist cushion fit around said wrist support shaft.

14. The apparatus according to claim 12, wherein said wrist support shaft is inwardly tapered toward a wrist support shaft midpoint to center the user wrist on the wrist support shaft.

15. A hand elevation apparatus, comprising:

a substantially horizontal frame support surface;

a frame structure for supporting a user wrist comprising two spaced apart disk end portions formed of chemical resistant material and resting on said frame support surface for rolling across said frame support surface;

a wrist support shaft extending axially between and interconnecting said disk end portions;

and a wrist cushion slidably encircling said wrist support shaft between said disk end portions, such that said wrist cushion is slidably rotatable relative to and around said wrist support shaft.

16. The apparatus according to claim 15, wherein said wrist support shaft is inwardly tapered toward a wrist support shaft midpoint to center the user wrist on the wrist support shaft.

17. A hand elevation apparatus, comprising:

a substantially horizontal frame support surface;

a frame structure for supporting a user wrist comprising two spaced apart disk end portions resting on said frame support surface adjacent to said frame support surface edge, for rolling across said frame support surface to position said frame structure relative to said frame support surface edge and to position the user wrist relative to said frame structure simultaneously;

a wrist support shaft extending axially between and interconnecting said disk end portions;

and a wrist cushion slidably encircling said wrist support shaft between said disk end portions, such that said wrist cushion is slidably rotatable relative to and around said wrist support shaft.

* * * * *